US006293094B1

(12) United States Patent
Schmidt et al.

(10) Patent No.: US 6,293,094 B1
(45) Date of Patent: Sep. 25, 2001

(54) METHOD FOR OPERATING AN INTERNAL COMBUSTION ENGINE AND SYSTEM AND WITH SULFUR-RICH EXHAUST GAS PURIFICATION COMPONENT AND AN INTERNAL COMBUSTION ENGINE SYSTEM OPERABLE THEREWITH

(75) Inventors: Jürgen Schmidt, Mühlacker; Gerd Tiefenbacher, Esslingen; Anton Waltner, Weinstadt, all of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/397,729

(22) Filed: Sep. 17, 1999

(30) Foreign Application Priority Data

Sep. 17, 1998 (DE) ..... 198 42 625

(51) Int. Cl.[7] ..... F01N 3/00

(52) U.S. Cl. ..... 60/284; 60/286; 60/289; 60/301

(58) Field of Search ..... 60/284, 285, 286, 60/289, 301, 297; 423/239.1

(56) References Cited

U.S. PATENT DOCUMENTS 3,943,709 * 3/1976 Holt ..... 60/284
5,362,463 * 11/1994 Stiles et al. ..... 423/239.1
5,459,999 * 10/1995 Hosoya et al. ..... 60/284
5,473,890 * 12/1995 Takeshima et al. ..... 60/285
5,577,383 * 11/1996 Kuroda et al. ..... 60/284
5,656,244 * 8/1997 Cole ..... 60/297
5,724,808 * 3/1998 Ito et al. ..... 60/285
5,765,368 * 6/1998 Matsumoto et al. ..... 60/284
5,802,845 * 9/1998 Abe et al. ..... 60/289
5,832,722 * 11/1998 Cullen et al. ..... 60/285
5,974,791 * 11/1999 Hirota et al. ..... 60/286

FOREIGN PATENT DOCUMENTS

19522165 A1 12/1995 (DE) .
19522165A1 12/1995 (DE) .
19747222C1 10/1997 (DE) .
19744738 A1 4/1998 (DE) .
0636770 A1 8/1994 (EP) .
0636770A1 8/1994 (EP) .

* cited by examiner

*Primary Examiner*—Thomas Denion
*Assistant Examiner*—Tu M. Nguyen
(74) *Attorney, Agent, or Firm*—Crowell & Moring LLP

(57) ABSTRACT

A method for operating an internal combustion engine system includes operating the internal combustion engine system in a desulfurization mode each time following a cold-start of the engine prior to the transition to a normal operating mode. The internal combustion engine system includes (1) an exhaust line; (2) a sulfur-rich exhaust purification component comprising at least two exhaust purification units connected in series in the exhaust line; and (3) a secondary air supply having separate branches for the sulfur-rich exhaust purification units.

3 Claims, 2 Drawing Sheets

METHOD FOR OPERATING AN INTERNAL COMBUSTION ENGINE AND SYSTEM AND WITH SULFUR-RICH EXHAUST GAS PURIFICATION COMPONENT AND AN INTERNAL COMBUSTION ENGINE SYSTEM OPERABLE THEREWITH

BACKGROUND AND SUMMARY OF INVENTION

This application claims the priority of German Patent Document 198 42 625.9, filed Sept. 17, 1998, the disclosure of which is expressly incorporated by reference herein.

The present invention relates to a method for operating an internal combustion engine system as well as an internal combustion engine system operable by such a method. Systems of this kind are used especially in motor vehicles and contain an exhaust purification component in which sulfur in the fuel is contained during operation. Such sulfur-rich exhaust purification components can be, in particular, nitrogen oxide (NOx) storage catalytic converters or so-called sulfur traps.

The sulfur-rich exhaust purification component requires desulfurization from time to time in order to free it of accumulated sulfur, usually in the form of sulfate. Thus, for example, it is known that sulfur poisoning of NOx storage catalytic converters reduces their storage capacity. It is also known that desulfurization takes place preferably with elevated exhaust temperatures and rich exhaust compositions.

Conventionally, desulfurization processes with the engine running are always conducted when the sulfur content in the sulfur-rich exhaust purification component has exceeded a certain amount. This is assumed in the case of a NOx storage catalytic converter, for example, when its storage capacity declines significantly. In methods of this kind, as described in Offenlegungsschrift EP 0 636 770 A1 and German Patent Application No. 197 47 222.2, the declining NOx storage capacity is detected when the adsorption and desorption phases grow shorter. The duration of the adsorption phases can be monitored by a NOx sensor positioned downstream from the NOx storage catalytic converter, while the duration of the desorption phases can be monitored by an oxygen sensor at the same location.

To perform the desulfurization phases, it is proposed in EP 0 636 770 A1 to switch the engine from a lean air ratio to a rich air ratio (in other words, the air/fuel ratio of the air/fuel mixture supplied to the engine) and, if necessary, also to activate an electrical heating unit for the NOx storage catalytic converter. The respective desulfurization phase is maintained for a specified time interval of 10 minutes, for example. In the method in German Patent Application No. 197 47 222.2, the setting of a sufficiently rich engine air ratio is accompanied by addition of secondary air to the exhaust line upstream of the NOx storage catalytic converter. Regulation, and not simply control, of the catalytic converter air ratio (the air/fuel ratio of the exhaust flowing through the NOx storage catalytic converter) can be provided and the catalytic converter temperature can be set to a desired value.

Offenlegungsschrift DE 195 22 165 A1 discloses another method with periodic desulfurization of a NOx storage catalytic converter during engine operation following determination of a decline in its storage capacity. In order to activate a desulfurization phase, (1) a switch is made to a richer engine air ratio and a later ignition point for the respective engine cylinder, and (2) secondary air is also supplied to the exhaust line upstream of the NOx storage catalytic converter. This is preferably performed in such manner that the catalytic converter temperature is set to a desired elevated setpoint during the desulfurization which is maintained for a period of time that can be specified.

The object of the present invention is to provide a method and an internal combustion engine system in which an excessive accumulation of sulfur in a sulfur-rich exhaust purification component is avoided by suitable desulfurization processes that affect normal engine operation as little as possible and do not cause any significant increase in fuel consumption. The internal combustion engine system may be used in automobiles, for example.

This object is achieved by an operating method as well as an internal combustion engine system according to the present invention.

In accordance with a method according to the present invention, a desulfurization process is triggered at each cold start of the engine system to a corresponding desulfurization mode. During the time following a cold-start activation, the engine is usually not operated primarily in accordance with fuel consumption minimization criteria (like those applied for normal operating modes when the engine is warm) because, for example, an attempt is first made in a catalytic converter heating mode to bring the available exhaust purification components, especially one or more exhaust catalytic converters, up to operating temperature as quickly as possible. For this purpose, for example, the engine cannot yet be driven using so-called consumption-favorable stratified charge operation, and appropriate catalytic converter heating measures are advantageous even in engines with direct injection.

Because the engine catalytic converter heating measures, which include, for example, the setting of a rich engine air ratio, largely correspond to the engine measures for desulfurization of the sulfur-rich exhaust purification components, the process according to the present invention does not result in significantly higher fuel consumption by comparison with system operation without desulfurization processes. Since the time intervals after which the next desulfurization process is necessary are typically much longer than the time intervals between successive cold starts, the cold-start desulfurization phases generally suffice to achieve timely and adequate desulfurization without additional desulfurization processes being necessary with a warm engine. As a result, normal engine operation is not disturbed and there is no associated increase in fuel consumption.

In another method according to the present invention, following the activation of an engine cold start, the operation of the engine system is initially set to a catalytic converter heating mode until the temperature of the sulfur-rich exhaust purification components exceeds a minimum desulfurization that can be specified in advance, whereupon operation is switched to the desulfurization mode. The initial catalytic converter heating mode permits very rapid attainment of a sufficient desulfurization temperature for the exhaust purification components to be desulfurized. In another embodiment, secondary air is fed into the sulfur-rich exhaust purification component or into the exhaust line upstream thereof in the catalytic converter heating mode, so that the exhaust temperature is allowed to rise rapidly in conjunction with the selection of the rich engine air ratio. Following a switch to the desulfurization mode, the secondary air feed is terminated.

Another embodiment is suitable for internal combustion engine systems that have an oxidation catalytic converter unit (i.e., an oxidizing function) in the exhaust line downstream of the sulfur-rich exhaust purification component, for example, a 3-way catalytic converter or a NOx storage catalytic converter. According to this method, secondary air is fed into the exhaust line for the oxidation catalytic converter unit during desulfurization, in other words directly into the unit or into the exhaust line section between the unit and the exhaust purification component which is then both desorbing and sulfurrich. This feeding of secondary air permits oxidation of both carbon monoxide and unburned hydrocarbons as well as any hydrogen sulfide produced during sulfurization.

An operating method according to another embodiment is suitable for internal combustion engine systems with two or more sulfur-rich exhaust purification units connected in series. According to this method, the sulfur-rich exhaust purification units in the desulfurization mode are desulfurized in succession, in a sequence which corresponds to the exhaust flow direction. This desulfurization process is accompanied by secondary air being introduced into the exhaust line in each case only downstream of the respective sulfur-rich exhaust purification unit that is being desulfurized. Thus, an undesired secondary air supply to the exhaust purification unit which is currently being desulfurized is avoided and oxidation of carbon monoxide, unburned hydrocarbons, and any hydrogen sulfide that may result during desulfurization is ensured.

In a method according to another embodiment of the present invention, which includes the catalytic converter heating mode followed by the desulfurization mode following cold-start activation, the engine air ratio is advantageously set to be slightly rich in the desulfurization mode, in other words richer in fuel than the stoichiometric ratio, but poorer in fuel than in the catalytic converter heating mode, which has a favorable effect on fuel consumption.

According to another method of the present invention, the duration of the respective desulfurization mode is determined by using (1) a sensor to monitor the sulfur storage state of the sulfur-rich exhaust purification component, or (2) a model-based estimate. In such an estimate, in addition to the quantity of fuel consumed and the sulfur content of the fuel, natural desulfurization processes that occur from time to time are also taken into account. These include desulfurization processes that occur when the engine has been warmed up when, because of the current engine operating state, desulfurization-promoting conditions prevail in the sulfur-rich exhaust purification component, especially a sufficiently high temperature and a sufficiently rich air/fuel ratio of the exhaust, for example, during highway and/or full-load driving.

The internal combustion engine system according to the present invention includes at least two sulfur-rich exhaust purification units connected in series in the exhaust line, as well as secondary air supply means each of which contains a separate secondary air supply branch for the sulfur-rich exhaust purification units. In this way, a deliberate secondary air supply for the respective sulfur-rich exhaust purification components is possible, for example, to bring these components more rapidly to operating temperature or to oxidize hydrocarbons as well as carbon monoxide and/or hydrogen sulfide contained in the supplied exhaust.

The internal combustion engine system may also include an oxidation catalytic converter unit downstream of the sulfur-rich exhaust purification component, which can comprise one or more exhaust purification units in series. The secondary air supply means includes, in addition to one or more secondary air supply branches for the sulfur-rich exhaust purification components, an individual secondary air supply branch for the oxidation catalytic converter unit, so that, for example, hydrogen sulfide can be oxidized in this unit that is formed during a desulfurization process in the upstream sulfur-rich exhaust purification component.

Other objects, advantages and novel features of the present invention will become apparent from the following detailed description of the invention when considered in conjunction with the accompanying drawings.

DETAILED DESCRIPTION OF THE DRAWINGS

Figure 1:
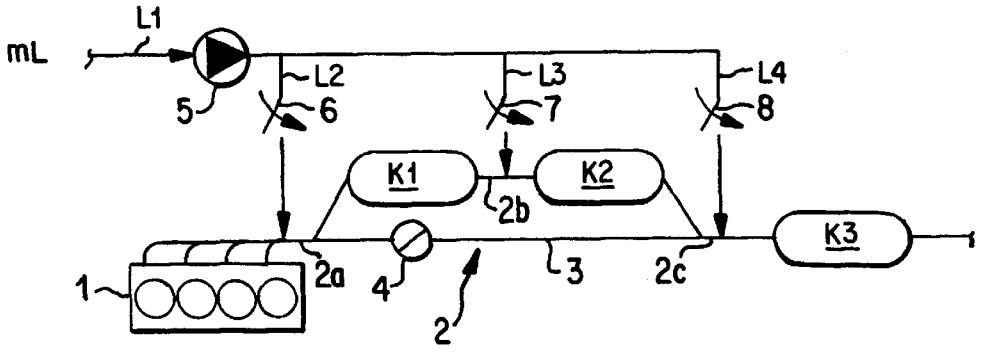
FIG. 1 is a schematic block diagram of an internal combustion engine system according to the present invention.

The internal combustion engine system shown in FIG. 1, which can be provided for a motor vehicle in particular, includes an internal combustion engine 1 to which an exhaust line 2 is connected on the output side.

An exhaust purification system is associated with exhaust line 2 and comprises (1) a sulfur-rich exhaust purification component in the form of two series-connected NOx storage catalytic converters K1, K2, and (2) a 3-way catalytic converter K3 connected downstream which, among other things, has an oxidizing function and hence functions as an oxidation catalytic converter unit. The two NOx storage catalytic converters can be bypassed, if necessary, with a bypass line 3 in which a controllable valve 4 is connected. The two NOx storage catalytic converters K1, K2 serve (1) to adsorb periodically the nitrogen oxides contained in the exhaust and (2) to desorb the nitrogen oxides again for conversion, for example by exhaust recycling or catalytic reduction, as is known and therefore requires no further explanation or inclusion in the drawings.

The exhaust purification system also includes desulfurization means to be able to free the NOx storage catalytic converter K1, K2 of enriched sulfur, more specifically of the sulfate that has a poisoning effect on the nitrogen oxide adsorption function. These desulfurization means comprise the secondary air supply means in the form of a secondary air line L1 with associated secondary air pump 5. The secondary air line L1 branches off downstream of pump 5 into three line branches L2, L3, L4. A first branch L2 terminates in a first exhaust line section 2*a* between engine 1 and the upstream NOx storage catalytic converter K1; a second branch L3 terminates in a second exhaust line section 2*b* between the two NOx storage catalytic converters K1, K2; and a third branch L4 terminates in a third exhaust line section 2*c* between the downstream NOx storage catalytic converter K2 and the 3-way catalytic converter K4. Each line branch L2, L3, L4 can be opened and closed by an associated controllable valve 6, 7, 8.

In addition, the desulfurization means may comprise a desulfurization control unit which preferably is integrated as a corresponding control part in software or hardware in an engine control device which controls engine 1 and the other components of the exhaust purification system 2. To the extent that the relative components are not shown in FIG. 1, conventional components known to the individual skilled in the art may be used for the purpose. The control units must be designed, however, so that they can operate the entire internal combustion engine system according to the method described below. The implementation of this operating method step in the engine control device, for example, is readily possible for the individual skilled in the art with knowledge of these method steps.

Figure 2:
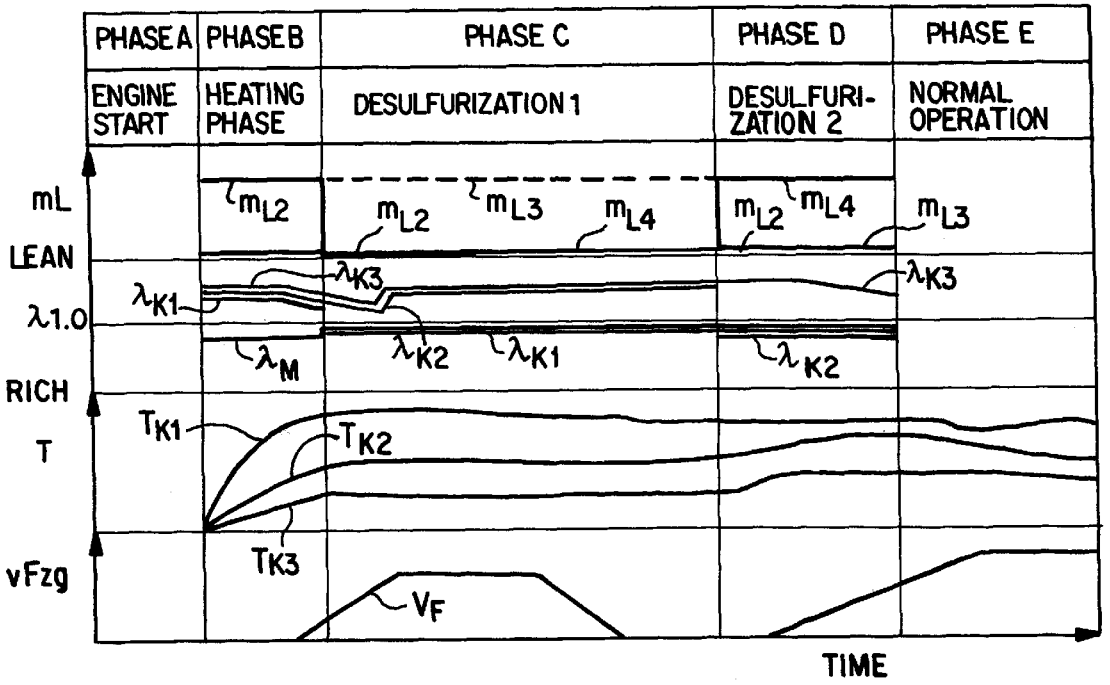
FIG. 2 is a schematic operating diagram of a method for operating the engine system according to FIG. 1.

In FIG. 2, an example of the operating method according to the present invention for the engine system in FIG. 1 is illustrated, showing schematically the time-dependent operating process for the case of a cold start. In FIG. 2, in four curves one above the other, the vehicle speed $v_{Fzg}$, the exhaust temperature T, the air/fuel ratio $\lambda$ and the secondary air mass $m_L$ (i.e., the quantity of secondary air supplied by the secondary air supply means to exhaust line 2) are shown as a function of time.

In a first very short phase, an engine start is initiated with a cold engine 1, in other words the vehicle speed $v_{Fzg}$ is zero and the exhaust temperature T air is equal to the ambient temperature. Following this activation of an engine cold start, operation is set to a catalytic converter heating mode in a subsequent phase B. In this mode, an increase in exhaust temperature is produced that is as rapid as possible, using corresponding engine control means and secondary air supply in order to bring the exhaust purification system, especially exhaust catalytic converters K1, K2, K3, rapidly to operating temperature. The air/fuel mixture supplied to engine 1 is enriched, in other words to a $\lambda$ value less than or equal to 1, as shown on a corresponding solid curve $\lambda_M$ of the engine-air ratio. At the same time, secondary air is fed into the upstream exhaust line section 2*a* through the first line branch L2, as shown by a corresponding solid first secondary air curve $m_{L2}$. The two other secondary air line branches L3, L4 remain closed.

The secondary air supply to the exhaust line section 2*a* branching off engine 1 results in a lean exhaust composition, in other words the $\lambda$ values $\lambda_{K1}$, $\lambda_{K2}$,$\lambda_{K3}$in the three catalytic converter units K1, K2, K3 are above the stoichiometric value of 1, as indicated by the dashed curve $\lambda_{K1}$, the solid curve $\lambda_{K2}$, and the dot-dashed curve $\lambda_{K3}$. As shown by corresponding temperature curves $T_{K1}$, $T_{K2}$, and $T_{K3}$, in a catalytic converter heating mode, the exhaust temperature $T_{K1}$ rises very rapidly upstream of the upstream NOx storage catalytic converter and at the end of this phase reaches a typical desulfurization temperature of approximately 550° C. or more to perform a subsequent desulfurization phase. Parallel to this, the exhaust temperature $T_{K2}$ upstream of the downstream NOx storage catalytic converter and the exhaust temperature $T_{K3}$ upstream of the 3-way catalytic converter K3 increase to a slightly lesser degree, with the 3-way catalytic converter K3 reaching its starting temperature at the end of heating phase B for the oxidation of unburned hydrocarbons and carbon monoxide. As can be seen from a speed curve $v_F$, the vehicle is started in the last half of heating phase B.

After the catalytic converter units K1, K2, K3 have been brought to operating temperature, a switch is made from the catalytic converter heating mode to a desulfurization mode that includes two successive desulfurization phases C and D.

In the first desulfurization phase C, engine system operation is set primarily for the desulfurization of the upstream NOx storage catalytic converter K1. For this purpose, the supply of secondary air through the first line branch L2 to this NOx storage catalytic converter K1 is shut off, in other words the corresponding air mass curve $m_{L2}$ drops to zero. At the same time, secondary air is supplied through the second line branch L3 into the exhaust line section 2*b* upstream of the downstream NOx storage catalytic converter K2, as can be seen from the rise of a corresponding dashed second secondary air curve $m_{L3}$. The engine air ratio $\lambda$ is raised at the transition to this desulfurization mode to a value that is only slightly below the stoichiometric value of 1, in other words engine 1 is operated slightly rich.

By these measures, the catalytic converter air ratio $\lambda$ in the upstream NOx storage catalytic converter K1 changes to a slightly rich value that promotes the desulfurization process while the catalytic converter air ratio $\lambda_{K2}$, $\lambda_{K3}$ in the other two catalytic converters K2, K3 does not change significantly and remains in the lean range. In these catalytic converter units K2, K3, both unburned hydrocarbons and carbon monoxide as well as the sulfur dioxide that possibly appears during the desulfurization of the upstream NOx storage catalytic converter K1 are oxidized as a result. Alternatively to the secondary air supply shown, a secondary air supply can be provided through the second line branch L3 alone in this operating phase, and with essentially the same effect, through only the third line branch L4 for the 3-way catalytic converter K3 or via the second and third line branches L3, L4.

Figure 3:
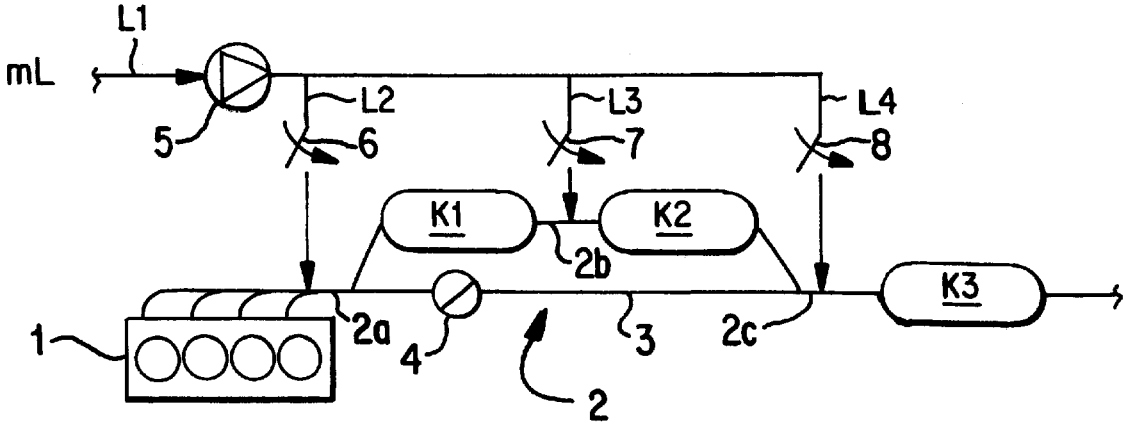
FIG. 3 is a schematic block diagram of an internal combustion engine system according to the present invention having a NOx sensor.

The duration of the desulfurization phases for the upstream NOx storage catalytic converter is determined by a model calculation for sulfur poisoning. In this model-based estimate of the sulfur content initially present in the NOx storage catalytic converter and to be desorbed, the critical influential parameters are the fuel used and its sulfur content, as well as the evaluation of natural desulfurization processes that can occur during a previous normal operating phase with the engine warm, in which the favorable conditions exist temporarily. This is the case, for example, in operating phases on the highway and under full load. In addition to or alternatively to this model-based estimate, a sensor diagnosis (9) of the NOx storage state can be provided, as shown in FIG. 3.

As soon as the first desulfurization phase C has been performed for the specified time, a switch is made to the second desulfurization phase D in which it is primarily the next NOx storage catalytic converter K2 in the exhaust flow direction that is desulfurized. For this purpose, the secondary air supply through the second line branch L3 for this downstream NOx storage catalytic converter K2 is terminated, in other words a corresponding curve $m_{L3}$ drops to zero at the same time, and no later than the introduction of secondary air through the third line branch L4 for the 3-way catalytic converter K3 10 begins, as shown by curve $m_{L4}$. The engine air ratio $\lambda_M$ is allowed to remain unchanged in the slightly rich area.

With this measure, the catalytic converter air ratio $\lambda_{K2}$ for the NOx storage catalytic converter K2 now to be desulfurized drops from the previously lean into the slightly rich area favorable for the desulfurization process. The catalytic converter air ratio $\lambda_{K3}$ in the 3-way catalytic converter K3 on the other hand remains in the lean range so that the oxidation of unburned hydrocarbons, carbon monoxide, and possibly the desulfurization of any hydrogen sulfide that appears is guaranteed.

As soon as the duration, suitably determined, of the desulfurization phase B for the downstream NOx storage catalytic converter K2 has expired, the engine system is reset for a following phase E of normal operation, in other words operation optimized for fuel consumption and engine performance. The engine air ratio $\lambda_M$ is set as lean as possible during normal operation. The nitrogen oxides that form in the engine as a result are absorbed by the NOx storage catalytic converters K1, K2. Since NOx absorption capacity is exhausted, they are subjected in conventional fashion to desorption processes, for which purpose the secondary air supply means can be activated if necessary.

It is understood that, in the manner described, more than two NOx storage catalytic converters connected in series or exhaust-purifying components that contain the sulfur in another manner can be desulfurized.

The operating method according to the present invention can also be used when there is a lack of a secondary air supply provided it permits exhaust emissions of unburned hydrocarbons and carbon monoxide in the cold-start phase. The suitable operating conditions are set exclusively by the operating control measures on engine 1 itself and without secondary air supply to the exhaust line. In particular, the engine is supplied with a rich exhaust mixture during the cold-start phase so that both rapid catalytic converter heating and desulfurization of the sulfur-rich exhaust purification components are achieved.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for operating an internal combustion engine system comprising an exhaust line; a sulfur-rich exhaust purification component located in the exhaust line; and a secondary air device, said method comprising:

desulfurizing the sulfur-rich exhaust purification component following each cold-start of the engine;

subsequently operating the engine in a normal operating mode; and determining a duration of the desulfurizing based upon an estimate of an amount of sulfur contained in the sulfur-rich exhaust purification component as a function of fuel, the sulfur content of the fuel, and desulfurization processes that occur during the normal operating mode.

2. A method for operating an internal combustion engine system comprising an exhaust line; a sulfur-rich exhaust purification component comprising a plurality of exhaust purification units connected in series located in the exhaust line; and a secondary air device, said method comprising:

following each cold-start of the engine, heating the sulfur-rich exhaust purification component to a predetermined temperature;

supplying secondary air at one or more points in the exhaust line to the sulfur-rich exhaust purification component or to an exhaust line section upstream of the sulfur-rich exhaust purification component during said heating;

terminating said supplying of secondary air;

switching to desulfurizing the sulfur-rich exhaust purification units in sucession;

introducing secondary air into the exhaust line at one or more points downstream of the corresponding sulfur-rich exhaust purification unit undergoing desulfurization; and subsequently operating the engine in a normal operating mode.

3. A method according to claim 1, wherein the sulfur-rich exhaust purification component is a $NO_x$ adsorber.

* * * * *